United States Patent [19]

Völkl et al.

[11] 4,311,308

[45] Jan. 19, 1982

[54] TENNIS RACKET

[75] Inventors: Franz Völkl; Günter Adam; Volker Klose, all of Straubing, Fed. Rep. of Germany

[73] Assignee: Franz Völkl OHG, Straubing, Fed. Rep. of Germany

[21] Appl. No.: 44,336

[22] Filed: May 31, 1979

[51] Int. Cl.[3] ..... A63B 49/02

[52] U.S. Cl. ..... 273/73 G

[58] Field of Search ..... 273/73 R, 73 C, 73 D, 273/73 E, 73 F, 73 G, 73 H

[56] References Cited

U.S. PATENT DOCUMENTS

| | | | |
|---|---|---|---|
| 3,702,701 | 11/1972 | Vaughn et al. | 273/73 G X |
| 3,724,850 | 4/1973 | Stevens | 273/73 G X |
| 4,045,025 | 8/1977 | Staub et al. | 273/73 G X |
| 4,179,121 | 12/1979 | Kelmanski | 273/73 G |
| 4,180,263 | 12/1979 | Haines | 273/73 G |
| 4,209,170 | 6/1980 | Garver | 273/73 G |
| 4,247,103 | 1/1981 | Garver | 273/73 G |

FOREIGN PATENT DOCUMENTS

| | | | |
|---|---|---|---|
| 1578059 | 8/1969 | France | 273/73 G |
| 247773 | 2/1926 | United Kingdom | 273/73 E |

OTHER PUBLICATIONS

"The Sporting Goods Dealer", Sep. 1976, p. 32.

*Primary Examiner*—Richard J. Apley
*Attorney, Agent, or Firm*—Michael J. Striker

[57] ABSTRACT

A tennis racket includes a handle portion, a frame portion which has strings mounted therein and a throat portion which connects the handle portion and the frame portion. An insert is installed in the throat portion and connected to the same. The insert is adapted to have secured thereto at least some of the strings. The insert may undergo elastic yielding in direction substantially normal to the general plane of the frame portion in response to the impact of a ball onto the strings and consequent transmission of the impact stress from the strings to the insert.

9 Claims, 13 Drawing Figures

TENNIS RACKET

BACKGROUND OF THE INVENTION

The present invention relates to tennis rackets.

It is known to manufacture a tennis racket having a handle portion, a frame portion adapted to have strings mounted thereon and a throat portion connecting the handle and the frame portion. It is also known to provide an insert in the throat portion, connected to the same and adapted to have secured thereto at least some of the strings normally mounted in the frame.

It has been known to manufacture tennis rackets of laminated wood. However, recently the tennis rackets are manufactured from synthetic plastic material, metal or any other material so as to completely or at least substantially exclude (i.e. substitute) wood.

The strings are known to be manufactured of lamb's gut (i.e. which is quite expensive) or oil-filled plastic capillaries.

The above-mentioned some strings extend through the insert outwardly away therefrom towards the respective sections of the throat portion and are secured thereto. The number of these strings (i.e. extending through the insert) varies depending upon the actual construction of the tennis racket in general and the insert in particular. As a rule, there are between ten and sixteen of such strings on the tennis rackets of this type (i.e. having the inserts).

The inset is usually made of synthetic plastic material, which preferably has a substantially low cold deformation characteristics, for example, a suitable type of polyamide.

The tennis rackets of this type are characterized by the fact that a normal hit (i.e. so-called "sweet spot" or "sweet point") of a ball occurs not right in the center of the frame portion, but somewhere between the center of the frame portion and the throat portion. Usually, the section of the strings which hits the ball may be determined by relation between the position of the frame portion of the racket and the center of gravity of the tennis racket, which usually is located in the area of the throat portion. This rule is long since known. Such tennis rackets have been known since thirties. The first examples of these tennis rackets used to have an extremely enlarged frame portion and a respectively reduced handle portion. Even to this day, there are some suggestions (e.g. German Offenlegungsschrift No. 2 546 028) to provide a tennis racket with a relatively large frame portion. Such a tennis racket, obviously, has some advantages, e.g. a player hits the ball with a comparatively light impact. However, such a tennis racket with a relatively large frame portion encounters a correspondingly increased air resistance which at least prevents a fast game. Another advantage of such a tennis racket resides in the fact that the geometric center of the frame portion is located close to the so-called "sweet point". This feature ensures that the elastic deflection (i.e. yielding) of the strings (which occurs in response to the impact of the ball onto the strings) normal to the general plane of the frame portion is substantially more uniformly distributed as opposed to the tennis rackets with the comparatively smaller frame portions. In this case, in response to the impact of the ball the elastically yieldable strings develop a counterforce which "strikes" the ball back. However, due to the rigidity of the insert, the strings which are secured thereto develop a component counterforce which is directed at a small angle relative to the ground to the general plane of the frame portion. Thus, should a player locate the frame portion so as to meet the ball perpendicular to the general plane of the frame portion (i.e. which is the most effective hit) then the ball reflects from the strings not perpendicular thereto (as desired) but at an angle relative to the normal to the general plane of the frame portion. This deflection from the desired direction of the ball flying from the tennis racket is determined by the above-mentioned component of the counteractive force of the elastically yieldable strings. Obviously, any deflection of the ball may significantly affect the eventual result of a tennis game.

SUMMARY OF THE INVENTION

It is a general object of the present invention to avoid the disadvantages of the prior art tennis rackets.

More particularly, it is an object of the present invention to eliminate completely or at least substantially the disadvantages of the tennis rackets with comparatively small and large frame portions.

Another object of the present invention is to provide a tennis racket which ensures that a ball hit by such a racket will fly in direction substantially perpendicular to the general plane of the frame portion of this tennis racket.

In pursuance of these objects and others which will become apparent hereafter, one feature of the present invention resides in providing a tennis racket which has a handle portion, a frame portion adapted to have strings mounted therein and a throat portion connecting the handle and frame portion.

An insert is installed in said throat portion and connected to the same. The insert is adapted to have secured thereto at least some of the strings normally mounted in said frame portion.

In accordance with one advantageous feature of the present invention, there are provided means for permitting said insert to undergo elastic yielding in direction substantially normal to the general plane of the frame portion in response to the impact of a ball onto the strings and consequent transmission of the impact stress from said strings to said insert.

Thus, any assymetry between the deflection of the strings, namely longitudinal strings (i.e. substantially parallel to the elongation of the handle portion), which is likely to occur in the prior art tennis rackets in response to the impact of the ball onto the strings between the geometrical center of the frame portion and the throat portion, is prevented. Obviously, all the possible negative consequences of such asymmetry are excluded.

In another feature of the present invention, a middle portion of the insert undergoes elastic yielding in direction substantially normal to the general plane of the frame portion.

In other words, at least a portion of the insert acts as an extension (i.e. in a longitudinal direction) of the strings, since in response to the impact of the ball the impact stresses transmitted on the insert by the longitudinal strings cause a certain deflection (i.e. elastic yielding) of the insert. Obviously, when the ball hits the area of the frame portion adjacent to the insert the tension of the transverse strings (i.e. substantially normal to the elongation of the handle) correspondingly increases since the respective fixing places of these transverse strings on the frame portion do not yield at all. However, the distance between the point (i.e. section) of the transverse strings which engages the ball (i.e. the section which takes up the impact of the ball) and the fixing places of the transverse strings substantially exceeds that of the longitudinal strings secured to the insert. This fact ensures, that all the impact stresses are distributed uniformly over all the strings.

It is to be understood, that the yielding of the insert in response to the impact of the ball onto the strings substantially exceeds that stipulated only by a natural elasticity of the insert (i.e. the case of the prior art tennis rackets provided with the inserts of synthetic plastic material). In a sense of the present invention, when the ball hits the strings, especially those which are secured onto the insert (i.e. in the center portion thereof) the latter deflects (i.e. yield considerably in direction normal to the general plane of the frame portion so that, depending upon the speed (i.e. impact) of the ball which hits the strings, the yield of the insert may constitute many milimeters which is obvious beyond any natural yielding (i.e. that due only to the elasticity of the material of the insert). Obviously, the maximum yielding of the insert may take place in the middle portion of the insert. In other words, the yielding value of the insert decreases in direction from the middle portion of the insert towards the outer end portions (i.e. flanges) thereof. Thus, in the areas of surfaces of the insert contacting the respective surfaces of the throat portion, the yielding is practically nill. A comparatively significant (i.e. big) yielding magnitude of the insert becomes possible because at least along a section (i.e. a line) of the insert, the latter has no (or significantly reduced) resistance to bending whatsoever. The insert may have one or more such lines (i.e. sections) having no resistance to bending. It is to be understood, the smaller the number of such lines the smaller the angle of the deflecting (i.e. yielding of the insert relative to the axis of symmetry of the tennis racket. This angle is about (i.e. below) 45°, and preferably 30°. However, in the case of one line this angle is 0°. Should the insert have many (i.e. more than one) such lines (i.e. sections), with no resistance to bending, they are then located symmetrically relative to the axis of symmetry of the tennis racket. The higher the number of such lines (i.e. sections) the higher the remaining residual rigidity of such sections.

The actual elasticity of the insert deflection (i.e. yielding) depends on a known torsional elasticity of the given material of the tennis racket (i.e. frame, throat and handle portions) when the insert is rigidly mounted on the throat portion. In this case the elasticity of the deflection is determined by the elasticity of the insert. It is to be understood, that in this case the elasticity of the insert must be limited, e.g. by way of certain construction measures, so that the insert may yield only in a predetermined (i.e. desired) direction. The force which returns the insert in its initial position, after the latter has been deflected, is determined by the strings which have been initially yielded in response to the impact of the ball. It is to be understood, that the strings, after having been deflected in direction from the general plane of the frame portion, have a strong (i.e. inherent) tendency to return to their initial position, i.e. before they have been deflected, into the general plane of the frame portion. Such an arrangement is preferable. This is especially true when the insert is held in the throat portion primarily due to the strings secured thereto rather than just a few screws (i.e. which connect the insert, at a lower portion thereof, to the throat portion) or any other locking elements which alone cannot adequately hold the insert in the throat portion. However, the arrangement where the insert is held in the throat portion primarily by the strings (i.e. the screws or the like only additionally support the insert in such a position) is long since known in the art of tennis rackets.

According to a preferred embodiment of the present invention, the insert is provided with at least one hinge (i.e. articulated) joint located substantially coaxial with the axis of symmetry of the tennis racket. Thus, the insert does not constitute a rigid bridge connecting the opposite sides of the throat portion. In other words, this insert comprises two pieces (in the case of one hinge joint) which swing relative to one another on the hinge joint. The hinge joint permits a considerably pivoting movement of the pieces of the insert relative to the general plane of the frame portion. Obviously, such a pivoting movement exceeds even a maximum elastic yielding of the insert stipulated only by the elastic yielding of the same. In this case, the pivoting movement of the insert takes place substantially along the middle line of the insert, which line corresponds to the axis of symmetry of the tennis racket.

It must be understood that no strings should extend at the area of the hinge point in the insert.

In accordance with another embodiment of the present invention, the insert is provided with two similar hinge joints (units). In this case, the respective axes of the hinge units may extend at an angle to each other and diverging from each other in the direction towards the respective sections of the throat portion. However, the respective axes of the hinge units may extend differently relative to each other for example they may be parallel to each other and to the axis of symmetry of the tennis racket. In this case, the respective axes of the hinge units are equally spaced from the axis of symmetry of the tennis racket.

The hinge unit (or units) may have different forms and constructions.

In a preferred embodiment of the present invention, the hinge unit includes a shaft (i.e. a pin) extending through respective bores provided on the respective portions of both pieces of the insert. When the pieces of the insert are in assembly with each other the bores constitute together one unobstructed guide passage which receives the shaft. In order to eliminate any axial shifting (i.e. sliding) of the shaft along the guide passage both opposite ends of the shaft are provided with respective enlarged portions.

Instead of the bore (or bores), each piece of the insert may be provided on a respective engaging surface thereof with a groove open outwardly away. When such pieces are in assembly with each other, i.e. the engaging surfaces of the pieces are directed to one another, the grooves on these engaging surfaces constitute together a substantially circumferentially complete guide passage for the hinge shaft. Each groove is so shaped as to embrace the hinge shaft circumferentially over a little bit less than 180°.

According to another embodiment of the present invention, instead of providing the hinge unit, the central portion of the insert is formed with a weakened section, that is the section having a thickness substantially smaller than that of the remaining portion of the insert. Obviously, the relatively thin section of the insert has an elasticity exceeding that of the relatively thick section. It is preferably to arrange the relatively thin section along the middle axis of the insert (which axis coincides with the axis of symmetry of the tennis racket).

According to still another embodiment of the present invention, the insert is provided with a slot (or slots) extending along the axis of symmetry of the insert. However, in this case, one must keep in mind that respective webs of the material of the insert, between the slot and the respective flanges of the insert have to be strong enough to resist (i.e. without breaking) even the strongest impacts of the ball. It is to be said that the same is entirely valid to the hereabove described embodiment having the weakened section.

Such a configuration of the insert is especially advantageous, since it permits to save some material of the insert and significantly reduce the manufacturing expenses of the same. The insert may be manufactured by way of the die-casting process.

The insert may be of a hard elastic synthetic plastic material. It is preferable to manufacture the insert having a very small thickness. The insert is casted with a plurality of throughgoing holes (i.e. bores) which are operative to receive therethrough the respective strings. In order to increase the rigidity of the insert, the latter may be casted with ribs increasing the thickness of the insert only at the areas of the throughgoing holes. The ribs extend over an outer surface (or surfaces) of the insert and angularly i.e. parallel to the elongation of the throughgoing holes. Such a configuration of the insert renders it possible even further to reduce the thickness of the same. Obviously, the smaller the thickness of the insert the higher the elasticity of the same. Since the ribs extend angularly relative to the respective flanges of the insert, the yielding ability of the latter is comparatively high. This is true, because the flanges of the insert become more rigid in the direction of the elongation of the insert without additionally increasing the rigidity of the latter transversely to the elongation of the insert in the general plane of the frame portion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
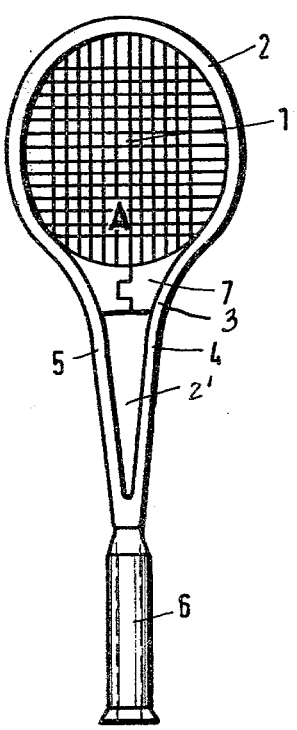
FIG. 1 is a front vertical view of a tennis racket in accordance with the present invention.
Figure 4:
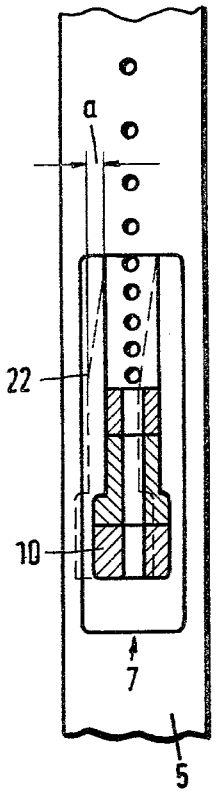
FIG. 4 is a section of the insert taken along a line IV—IV in FIG. 2.

Referring now to the drawing and first to FIG. 1 thereof it may be seen that the reference numeral 1 designates in toto strings mounted on a frame portion 2 which is connected through a throat portion 3 to a handle portion 2' having two opposite sections 4 and 5 which are together connected to a handle 6. Upper portions of the sections 4 and 5 respectively extend apart from each other. Lower portions of the sections 4 and 5 respectively extend in the handle 6 and along the entire elongation thereof. The lower portions of the sections 4 and 5 respectively may also be apart from each other even in the handle 6. However, in a preferred embodiment of the present invention, the lower portions of the sections 4 and 5 may be brought in contact with each other before they enter the handle 6 (see FIG. 1).

The frame, throat and handle portions constitute a hollow rod which is bent correspondingly. The hollow interior of the rod may be filled with a foam filler of synthetic plastic material, for example epoxy resin reinforced by a plurality of glass or carbon filaments. The rod may be, for example, of thermosetting plastics.

However, the rod may constitute a hollow metal tube which is correspondingly shaped.

An insert 7 is installed in the throat portion 3 which is of synthetic plastic material, for example, polyamide. The insert 7 is supported on the respective inner sections of the throat portion 3 by screws 8 (see FIG. 2). The insert 7 is a substantially flat plate located substantially in a general plane of the frame portion 2. The insert 7 has a configuration which is similar to a butterfly. The insert 7 has side flanges 10 for engaging the respective sections of the inner surface of the throat portion 3 and preventing any shifting of the insert 7 normally to the general plane of the frame portion 2 once the insert 7 is installed in the throat portion 3. A lower section of the insert 7, i.e. the section facing away from the strings 1, is provided (i.e. reinforced) with an enlarged portion (i.e. bulge). The side flanges 10 and the screws 8 do not project outwardly away from the outer surface and the side edges of the throat portion 3. Such an arrangement ensures a reliable position of the insert 7 relative to the throat portion 3.

The insert 7 is practically fixed on the throat portion 3 by the strings 1, or at least by some of them.

At least some of the longitudinal strings **1*a* (see FIG. 2) extend through respective inclined bores 12 provided in the insert 7 towards the respective sections 3' and 3''. Thus, a longitudinal string 1*a* extends through a corresponding bore 12 towards and through a hole 12', provided in a wall of the throat portion 3, and further outwardly away therefrom and into an adjacent hole 12' and the respective bore 12 towards and into an interior of the frame portion 2. It is to be mentioned that the strings 1 are tensioned (i.e. stressed) in such a position with a corresponding stress. This stress is transmitted through the respective longitudinal strings 1*a* onto the insert 7 so as to reliably fix the latter in the throat portion 3. In other words, the insert 7** is urged by the strings against the respective inner surface of the sections 3′ and 3″ of the throat portion 3 respectively. The respective opposite sections of the frame portion 2 are tensioned in direction towards each other by the transverse strings 1*b*. The opposite sections 4 and 5 of the handle portion 2, are held together by the handle 6.

The hereabove described construction of a tennis racket is known in the art. Such a tennis racket usually hits a ball somewhere in the area between the center of the frame portion 2 and the insert 7. In order to provide the strings 1 in general, and the longitudinal strings 1*a* (which extend through the insert 7) in particular, with an adequate elasticity (i.e. elastic yielding) the prior art teaches to increase tensional stresses of these strings. However, in the case of the present invention, instead of correspondingly tensioning the strings in direction towards the handle portion, the insert 7 is formed so as to be able to yield (i.e. deform) elastically in direction normal to the general plane of the frame portion 2.

According to a preferred embodiment of the invention (see FIGS. 1–4), the insert 7 is provided, along an axis of symmetry 15 of the tennis racket, with a hinge unit 16. The hinge unit 16 includes a shaft 17 having a longitudinal axis which coincides with the axis 15. The shaft 17 extends through corresponding holes of outer projections 18 and 19 of one piece (i.e. left one if seen in FIG. 2) of the insert 7 and a central projection 20 of another piece (i.e. right one if seen in FIG. 2) of the insert 7. When the two pieces of the insert 7 are in assembly with each other, the central projection 20 extends between the outer projections 18 and 19 so as to constitute together an unobstructed guide passage which receives the shaft 17. The shaft 17 may be for example of steel. In order to eliminate any axial movement of the shaft 17 along this passage, the shaft 17 may be pressed in one of the respective holes of the projections 18–20. Instead of that (or in addition thereto) the respective end portions of the shaft 17 may be provided with respective enlarged portions which prevent any axial movement of the shaft 17 along the guide passage.

Usually the ball hits the area of the frame portion, designated by A. Due to the impact of the ball onto the strings 1, the latter becomes deflected (i.e. elastically yielded) in direction normal to the general plane of the frame portion 2. The insert 7, which is held in its normal position (i.e. in the general plane of the frame portion 2) by the longitudinal strings 1*a* which extend through the insert 17, becomes also elastically yielded in the same direction due to the consequent transmission of the impact stresses from the above-mentioned longitudinal strings 1*a* to the insert 7. The yielded position of the insert 7 is shown in dotted lines 22.

The distance of the maximum yield (i.e. deflection) of the insert 7 from its normal position is designated by a. Such a deflection of the insert 7 becomes possible due to the hinge unit 16 provided on the insert 7. The deflection of the lower part of the insert 7 (i.e. the part which is closer to the handle portion 2′) is smaller than that of the upper part of the insert 7. Such a different deflection ratio of the upper and lower parts of the insert 7 is desirable in the present invention.

It has been noticed during innumerable playing experiments, that the tennis racket of the present invention renders it possible for a player to hit a ball substantially lighter as opposed to the tennis rackets with the rigid insert where the player has to hit the ball comparatively hard to obtain the same result. It is true, that the known inserts are not really rigid in the exact meaning of the word. In fact the known insert does have some elasticity which is stipulated only by the natural elasticity of the material of the insert. Obviously, the natural elasticity of the material of the insert permits only a minute deflection (i.e. yielding) of the insert which cannot be compared with that in the case of the present invention.

Figure 2:
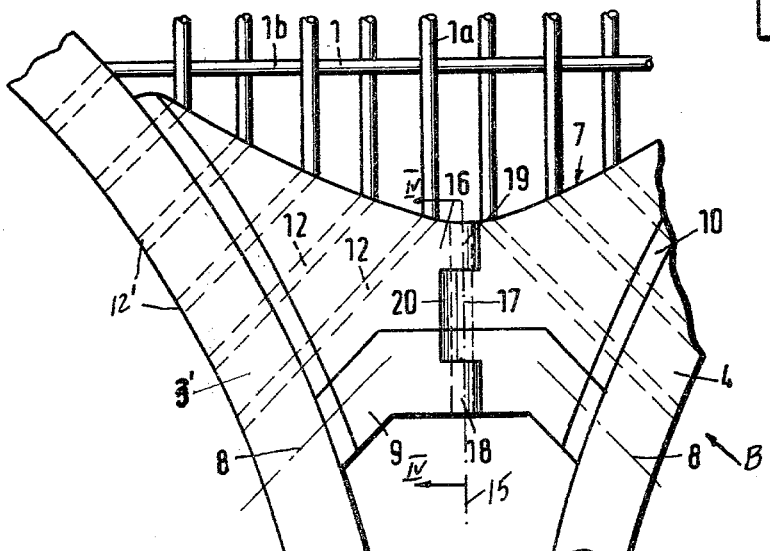
FIG. 2 is a front vertical view of a portion of the tennis racket shown in FIG. 1, in the natural scale.
Figure 3:
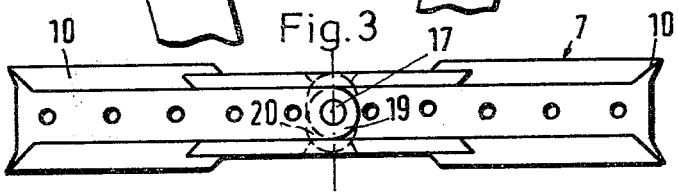
FIG. 3 is a view of an insert shown in FIG. 2 as seen in direction of an arrow B.
Figure 5:
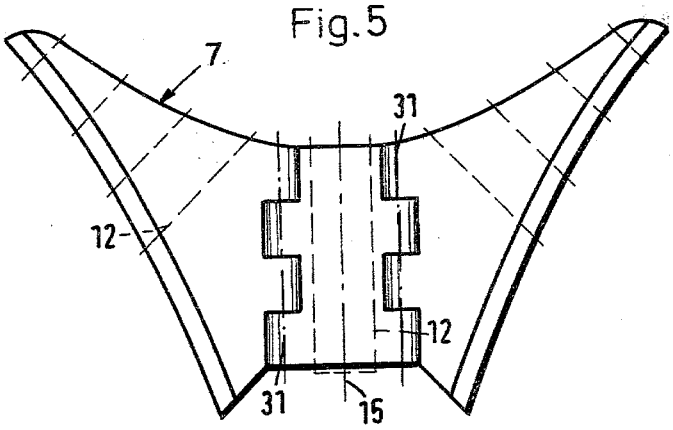
FIG. 5 is a schematic front view of another embodiment of the insert shown in FIG. 2.

FIG. 5 shows another embodiment of the insert 7 which has two hinge units as opposed to one in the case of the embodiment shown in FIG. 2. Each hinge unit of the insert 7 shown in FIG. 5 has an axis 31. The axes 31 are parallel to the axis of symmetry 15 of the tennis racket. The axes 31 are equally spaced from the axis 15. Such an arrangement renders it possible to change the bending line of the insert in direction normal to the general plane of the frame portion as compared with that of the embodiment shown in FIGS. 1–4. In the case of the embodiment shown in FIGS. 1–4, the bending line of the insert, having two pieces (i.e. left and right), has a most curved portion right in the middle thereof. In the case of the embodiment of the insert 7 shown in FIG. 5, the bending line is strongly rounded in direction from one side flange of the insert 7 to another flange.

Figure 6:
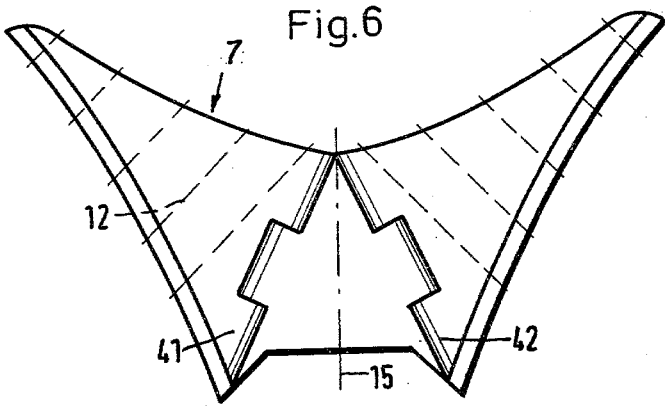
FIG. 6 is a schematic front view of still another embodiment of the insert.

FIG. 6 shows still another embodiment of the insert 7 which also has two hinge units having axes 41 and 42, respectively. The axes 41 and 42 extend symmetrically relative to the axis 15. However, the axes 41 and 42 are respectively inclined relative to the axis 15 from the both opposite sides thereof. Thus, the respective upper projections of the opposite pieces of the insert 7 tend to one point, in other words, the upper projections are inclined to approach each other, whereas the lower projections are inclined so as to part (diverge) from each other. Such an arrangement renders it possible to transmit the significant longitudinal tensile stresses not via the hinge unit (see FIGS. 1–4) but through the intermediate side contact of the separate pieces of the insert 7 with each other.

Figure 7:
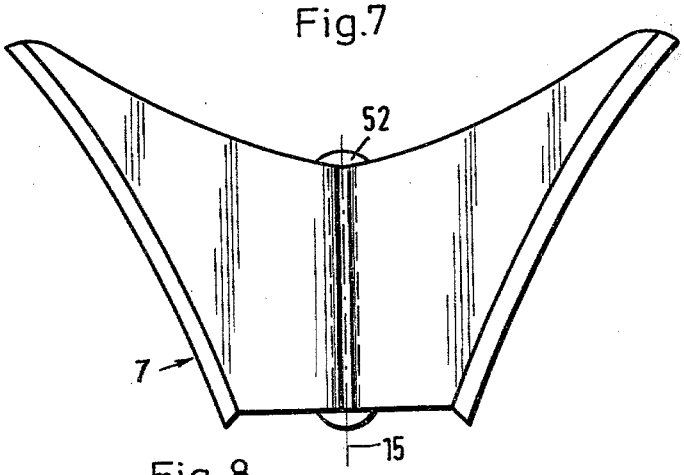
FIG. 7 is a schematic front view of yet another embodiment of the insert.
Figure 8:
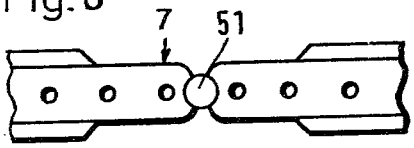
FIG. 8 is a top partial view of the embodiment shown in FIG. 7.

FIGS. 7 and 8 show yet another embodiment of the insert 7 which consists of two pieces. Each piece is provided at a respective longitudinal engaging face thereof with a cylindrical groove. When the pieces of the insert 7 are in assembly to each other, the respective cylindrical grooves constitute an uninterrupted circumferentially substantially complete guide passage operative for receiving a shaft 51. In other words, each groove separately surrounds the shaft 51 only along (or slightly less than) 180° so that during deformation (i.e. yielding) of the insert 7 the respective edges of the engaging faces of the opposite pieces do not engage one another. The shaft 51 is provided at both ends, which are axially spaced from each other, thereof with enlarged portion (i.e. bulges) 52 so as to eliminate any axial movement of the shaft 51 in the thusly developed guide passage when the insert 7 is in assembly and installed on the throat portion of the tennis racket. The cylindrical grooves of each piece of the insert 7 is coaxial with the axis 15. It must be understood that such an arrangement has to be so dimensioned and shaped as to avoid any possibilities that the shaft 51 falls out of the guide passage between the respective pieces of the insert 7 even if the impact of the ball on the strings is rather strong. In order to ensure this, the shaft 51 may be glued, for example by means of an epoxy resin glue, to the respective inner surfaces of the cylinder grooves. Such a preventive measure (i.e. gluing of the shaft 51 to the inner surfaces of the cylindrical grooves) renders it possible to provide an adequate sliding engagement between the outer surface of the shaft 51 and the inner surfaces of the grooves which is very important for increasing the efficiency of the insert during deflection of the same.

It is possible, however, to form the shaft 51 integrally connected with one of the separate pieces of the insert 7. The inner surface of the cylindrical groove on the respective other piece may be advantageously covered with polytetrafluoroethylene to thereby ensure the adequate sliding of the outer surface of the shaft 51 over the inner surface of this groove during deflection of the insert 7.

Figure 9:
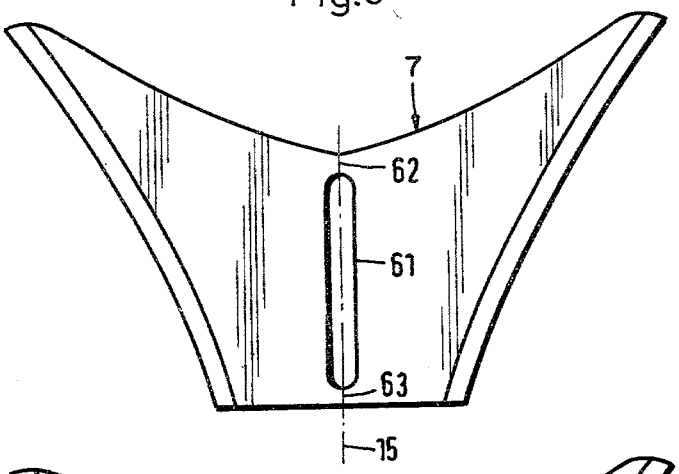
FIG. 9 is a schematic front view of a further embodiment of the insert.

FIG. 9 shows a further embodiment of the insert 7 which does not have any hinge units, similar to those shown in FIGS. 1–8, whatsoever. Instead, the insert 7 is provided with one (or more) elongated slot 61 which extends along the axis 15 over substantially the entire elongation of the insert 7 so as to leave only a relatively small web 62 between the slot 61 and the upper flange of the insert 7, and a relatively small web 63 between the slot 61 and the lower flange of the insert 7. Such an arrangement permits a considerable elastic yielding of the insert 7 normal to the general plane of the frame portion in response to the impact of the ball onto the strings and consequent transmission of the impact stress from the strings to the insert 7.

Figure 10:
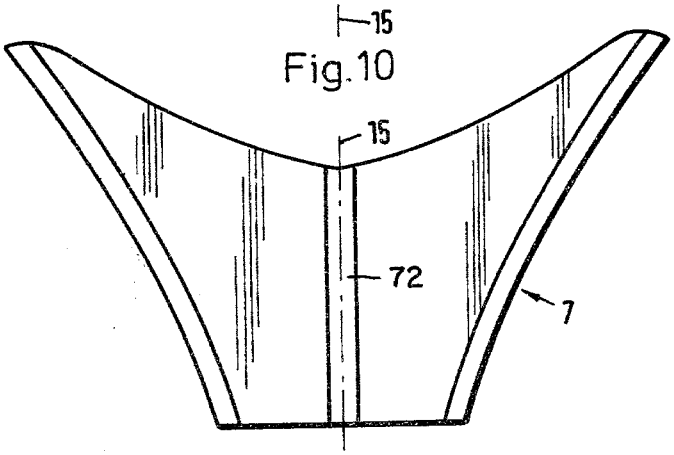
FIG. 10 is a schematic front view of a still further embodiment of the insert.
Figure 11:
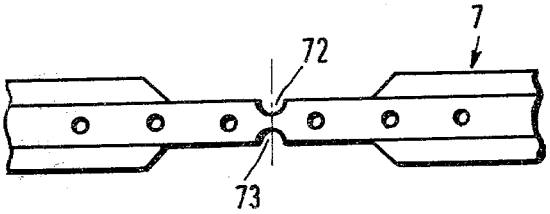
FIG. 11 is a top partial view of the embodiment shown in FIG. 10.

FIGS. 10 and 11 illustrate a still further embodiment of the insert 7 which does not have hinge units similar to those of the embodiments of the insert 7 shown in FIGS. 1–8. The axis of deflection of the insert 7 shown in FIGS. 10 and 11 coincides with the axis 15. The insert 7 shown in FIGS. 10 and 11 is of one piece and provided on both sides thereof along the axis 15 with opposite grooves 72 and 73, respectively. Thus, the grooves 72 and 73 are separated from each other only by a thin web having a thickness for example about 0.5 mm and forming a so-called film hinge. Obviously, the elasticity of such an insert is considerably increased as opposed to that having one and the same uninterrupted thickness—as in the case of the prior art tennis rackets.

Figure 12:
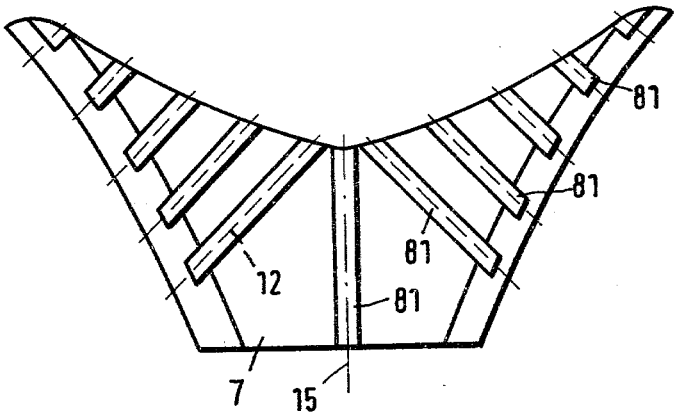
FIG. 12 is a schematic front view of a yet further embodiment of the insert.
Figure 13:
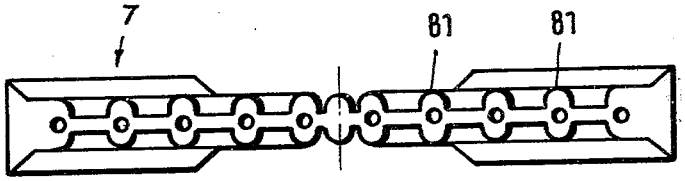
FIG. 13 is a top view of the embodiment shown in FIG. 12.

FIGS. 12 and 13 show a yet further embodiment of the insert 7, which is so formed (i.e. of one piece) that over the entire area of the elongation thereof it has the thickness of about 1 mm. Obviously, such an insert is substantially flexible and can considerably yield in direction normal to the general plane of the frame portion. The insert 7 shown in FIGS. 12 and 13 is provided at the outer surfaces thereof with ribs 81 which increase the thickness of the insert 7 only in the areas of the guide passages 12 for receiving the strings. Such a configuration of the insert 7 permits to save the material of the insert 7 without reducing the rigidity of the same. The ribs 81 on the one hand increase the rigidity of the insert 7 in the general plane of the frame portion and on the other hand they permit the insert 7 to undergo an elastic yielding within the desired limits and in direction away from the general plane of the frame portion.

It will be understood that each of the elements described above, or two or more together, may also find a useful application in other types of tennis rackets differing from the types described above.

While the invention has been illustrated and described as embodied in a tennis it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A tennis racket, comprising a handle portion; a frame portion adapted to have string mounted therein; a throat portion connecting the handle and frame portion; an insert in said throat portion connected to the same and adapted to have secured thereto at least some of a plurality of strings normally mounted in said frame portion; and means for permitting said insert to undergo elastic yielding in direction substantially normal to the general plane of said frame portion in response to the impact of a ball onto said strings and consequent transmission of the impact stress from said strings to said insert, said permitting means including at least one hinge unit having a hinge axis coinciding with an axis of symmetry of the tennis racket, wherein said insert being of two pieces and said one hinge unit including a shaft element operative for movably connecting said pieces of the insert so that said pieces may pivot relative to each other on said shaft in response to the impact stresses from said strings to said insert.

2. A racket as defined in claim 1, wherein said handle, frame and throat portions are of one correspondingly bent rod.

3. A racket as defined in claim 1, wherein said pieces are provided with engageable projections so shaped as to complement each other and together constitute said insert, said projections being provided with respective throughgoing holes so arranged on said respective projections that when the latter complement one another the respective holes constitute an unobstructed guide passage in said insert, operative for receiving said shaft.

4. A racket as defined in claim 1, wherein said insert is of hard elastic synthetic plastic material.

5. A racket as defined in claim 1, wherein said insert is provided with a plurality of throughgoing holes for receiving therethrough said strings, respectively.

6. A tennis racket, comprising a handle portion; a frame portion adapted to have string mounted therein; a throat portion connecting the handle and frame portion; an insert in said throat portion connected to the same and adapted to have secured thereto at least some of a plurality of strings normally mounted in said frame portion; and means for permitting said insert to undergo elastic yielding in direction substantially normal to the general plane to said frame portion in response to the impact of a ball onto said strings and consequent transmission of the impact stress from said strings to said insert, said permitting means including at least one hinge unit having a hinge axis which extends substantially along the axis of symmetry of the tennis racket, said insert being of two pieces and said one hinge unit including a shaft element operative for movably connecting said pieces of the insert so that said pieces may pivot relative to each other on said shaft in response to the impact stresses from said strings to said insert.

7. A racket as defined in claim 6, wherein said permitting means include a second such hinge unit having a hinge axis also extending substantially along the axis of symmetry of the tennis racket said two hinge units being arranged so that their hinge axes extend at different sides of the axis of symmetry of the tennis racket.

8. A racket as defined in claim 7, wherein said hinge axes are parallel to each other and to said axis of symmetry of the tennis racket.

9. A racket as defined in claim 7, wherein said hinge axes include between each other an angle converging towards the frame portion and diverging outwardly away therefrom and towards said handle portion.

* * * * *